United States Patent [19]

von Ronai-Horvath et al.

[11] 4,450,677

[45] May 29, 1984

[54] THREAD MONITOR AND A SLUBBING CLAMPING DEVICE FOR DRAW FRAMES OF SPINNING MACHINES EQUIPPED WITH DOUBLE UPPER ROLLERS

[75] Inventors: Michael von Ronai-Horvath, Ludwigsburg; Bernhard Schoenung, Filderstadt; Kurt Seebo, Esslingen, all of Fed. Rep. of Germany

[73] Assignee: SKF Kugellagerfabriken GmbH, Schweinfurt, Fed. Rep. of Germany

[21] Appl. No.: 433,107

[22] Filed: Oct. 6, 1982

[30] Foreign Application Priority Data

Oct. 6, 1981 [DE] Fed. Rep. of Germany ..... 3139667

[51] Int. Cl.[3] ..... D01H 13/16; D01H 13/18

[52] U.S. Cl. ..... 57/81; 19/0.21; 19/0.25; 57/86; 57/87

[58] Field of Search ..... 57/80, 81, 86, 87; 19/0.2, 0.21, 0.25, 0.26

[56] References Cited

U.S. PATENT DOCUMENTS

| | | | |
|---|---|---|---|
| 2,704,430 | 3/1955 | Harris | 57/81 |
| 3,043,991 | 7/1962 | Schneider et al. | 57/81 X |
| 3,841,076 | 10/1974 | Ford et al. | 57/87 X |
| 3,950,925 | 4/1976 | Igel | 57/81 X |
| 4,000,603 | 1/1977 | Lee, Jr. | 57/87 |

*Primary Examiner*—John Petrakes

*Attorney, Agent, or Firm*—Murray Schaffer

[57] ABSTRACT

A bearing rail is provided extending along each side of the draw frame and spaced laterally from the outer edges of the double upper rollers. At the end of the each rail, in the area when the thread exits from the exit rollers, each rail is provided with two carriers, one of which is provided with a light source and the other which with a light receiving photo-cell. The light source on one side of the drawing frame is arranged in association with the thread being drawn adjacent the photo-cell on the other side so that the light source causes this remote thread to cast a shadow on the photo-cell adjacent to it. Similarly the light source on the other side, the thread remote from it and the photo-cell opposite it are also aligned. The shadow on each photo-cell produces an alternating current which is then independently fed to a circuit and switch means, housed at the inlet end of the bearing rail. The switch means, such as a solenoid operates a clamping or arresting device which is movable between the lower inlet roller and the associated upper inlet roller, to clamp the slubbing between it and the upper roller thus preventing its continued feed into the draw frame.

7 Claims, 2 Drawing Figures

THREAD MONITOR AND A SLUBBING CLAMPING DEVICE FOR DRAW FRAMES OF SPINNING MACHINES EQUIPPED WITH DOUBLE UPPER ROLLERS

BACKGROUND OF THE INVENTION

The present invention relates to amonitoring device for sensing and controlling the passage of slubbing or fiber roving in the drawing frame of a textile spinning machine.

A known spinning machine is provided with a drawing frame having at least a set of inlet rollers for receiving the slubbing from a source, and a set of exit rollers spaced therefrom and between which the slubbing is drawn. The exit rollers, feed the drawn material, as thread or yarn to a bobbin or cop on which it is wound. The sets of rollers each comprise a driven lower and a pair of axial spaced (double) upper rollers permitting the drawing of two slubbings side by side. The upper rollers are journalled in ranked pairs on a common supporting arm extending in the direction of drawing. Such a machine is disclosed in DE-OS No. 22 57 323 and which also provides means for sensing the proper winding of the drawn thread. In DE-OS No. 22 57 323 a light source and a photo-light receiving cell is mounted on a carriage which moves alongside the machine in such a way that the light sensitive cell can be struck by the reflected part of the light current directed to the thread from the front of the machine. When the reflected beam is not received, a blowing device arranged on the carriage is switched on so that its air current strikes a baffle mounted swivable on the machine which arrests the slubbing with the swivel motion imparted to it by the air current. The slubbing claimping device is therefore activated only after a yarn break has occurred and when the carriage has reached the respective spinning site in the course of its travel. During the interim, the slubbing, which has continued its run up to the point of arrest, has wound itself by that time around the draw frame rollers.

If one were to assign to every spinning site a stationary thread monitor designed and arranged in this manner for the purpose of eliminating this shortcoming, it would have the result that its components would create an obstruction precisely at the site where piecing of the thread or slubbing must be performed. An arrangement wherein the light source and light-sensitive cell are placed laterally to the path of movement of the thread, which would grant better accessability, is not easily obtained because the thread running from the delivery end of the draw frame to the bobbin runs over a thread guide arranged on a rail so as to move up and down within such a large angular area that reliable control by beam reflection is not possible. Obstruction to the delivery end of the draw frame would result also if a thread monitor were used which did not work according to the reflection principle but according to the method of transmitted light, as suggested in (DE-OS No. 21 23 641) since the thread would run between components arranged in close proximity to each other (light source and light-sensitive cell).

In all cases where stationary thread monitors must be arranged at the delivery end of the draw frame and an associated slubbing clamping device at the entry point to the draw frame, the connecting of these two devices causes problems. A cable serving for the connection between the parts and for power supply can, as a rule, not be laid directly in the shortest way possible because of moving or adjustable components of the draw frame. It is for this reason necessary to connect the thread monitor with the switching element of the slubbing clamping device, for instance a solenoid (DE-OS No. 22 23 638) by way of a cable laid along the front of the machine and then back again around its one front side on the inside of the machine. With the multitude of linkages and connections to be made on the machine, this results in a corresponding multiwire harness and high assembly costs, particularly if a machine is to be equipped subsequently with electric thread monitors and slubbing clamping devices.

It is an object of the present invention to provide a thread or yarn monitor and accompanying slubbing clamping device for a draw frame of the type aforedescribed which eliminates the disadvantages and difficulties of the prior devices.

It is a further object of the present invention to provide a thread or yarn monitor and clamping device which may be arranged in association with each thread being drawn by the draw frame but which will not interfere with the normal operation of the frame or with the necessary manual functions necessary to fee, repiece, cleanse or otherwise handle the draw frame.

These objects as well as other objects and advantages are set forth and will be apparent from the following disclosure of the present invention.

SUMMARY OF THE INVENTION

According to the present invention, the draw frame of the type described earlier is provided with a bearing rail, extending along each side of the frame and spaced latterally from the outer edges of the respective double rollers. At the end of each rail, in the area when the thread exits from the exit rollers, each rail is provided with two carriers, one of which is provided with a light source and the other which with a light receiving photo-cell. The light source on one side of the drawing frame is arranged in association with the thread being drawn adjacent the photo-cell on the other side so that the light source causes this remote thread to cast a shadow on the photo-cell. Similarly the light source on the other side, the thread remote from it and the photo-cell opposite it are also aligned. The shadow on each photo-cell produces an alternating current which is then independently fed to a circuit and switch means, housed at the inlet end of the bearing rail. The switch means, such as a solenoid operates a clamping or arresting device which is movable between the lower inlet roller and the associated upper inlet roller, to clamp the slubbing between it and the upper roller thus preventing its continued feed into the draw frame.

Through the arrangement of the carriers containing the components of the sensor on both sides of a pair of threads associated with a supporting arm, the draw frame exit, in particular the space between the pair of threads, is kept freely accessible. In spite of this, it is possible by the manner in which the light source and light-sensitive cell are mutually assigned, to carry out the monitoring of the thread with the transmitted light method which works reliably within a large angle area as well as with relative large movements of the thread. The bearing rail units the carrier and the switching member for the slubbing clamping device into one structural group, which can be attached ready assembled to the machine. The normal support rod which extends over the length of the machine and serves for the mounting of the supporting arms, is particularly suited for its fastening. The separate mounting of the thread sensors and the switch elements on the machine and the requirement for having them connected by a cable laid on the machine, can then be dispensed with. This connection can be established by a cable running inside or on the bearing rail. The power can be supplied simply by laying a power cable alongside the machine, to which the individual bearing rails are connected by plug-in connections.

Further, the invention makes it possible to align the associated light source and light-sensitive cells in a simple manner with each other and with the path of movement of the thread to be monitored, and also to adapt them to draw frames of variable design and length of the total draft zone.

Full details of the present invention are set forth in the following description and are illustrated in the accompanying drawing.

DESCRIPTION OF THE INVENTION

Figures 1, 2:
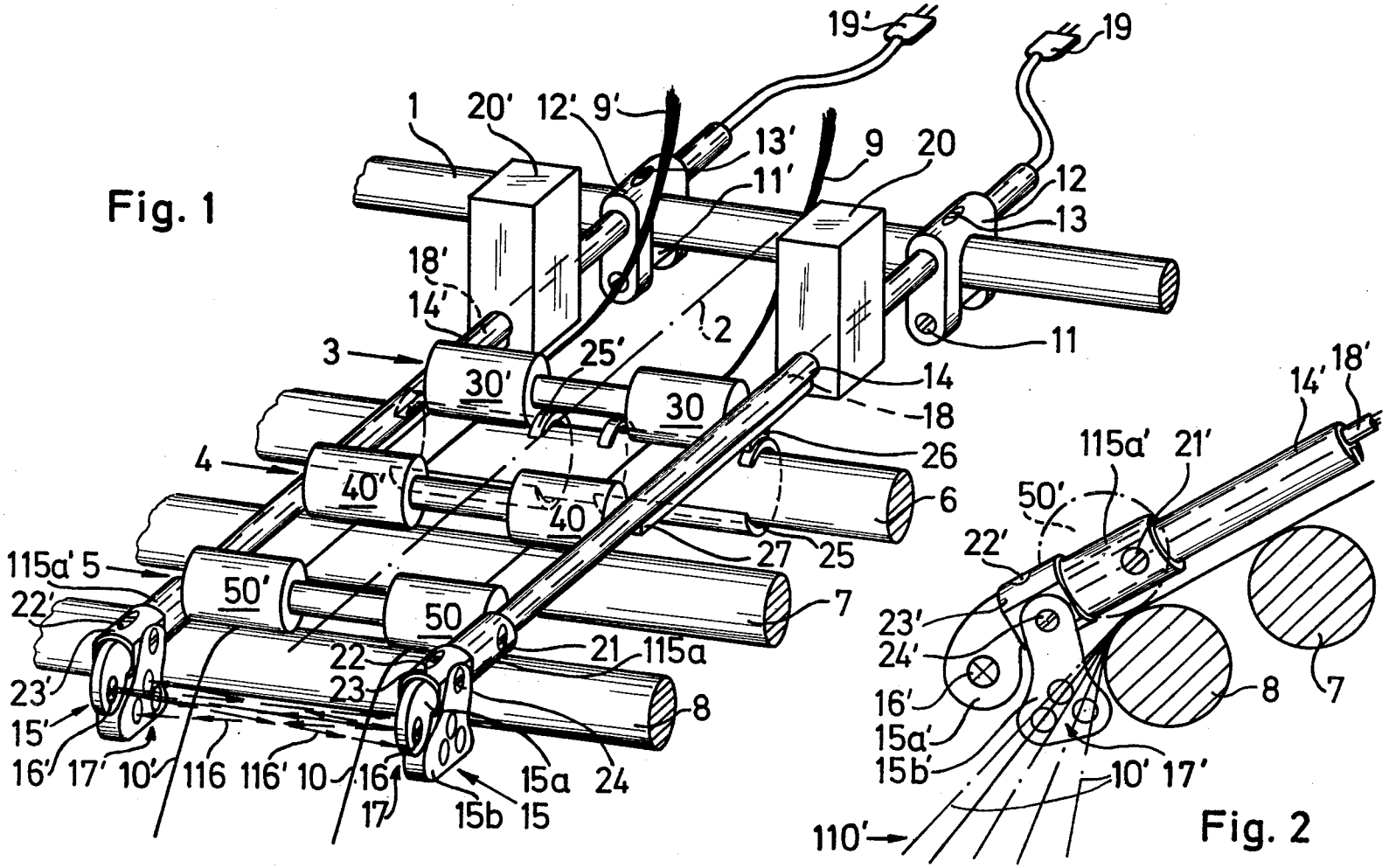
FIG. 1 is a perspective view of a draw frame equipped with double upper rollers, in simplified representation, whereby thread monitors are assigned to the two outgoing threads and clamping devices to the associated slubbings.
FIG. 2 is a plan view of a thread monitor.

As seen in FIG. 1 a support rod 1 runs the length of the draw frame machine and accommodates a plurality of support arms indicated by the dot-dash line 2. Mounted on the support arm 2, by their respective common axles are a pair of entry rollers 3, a pair of belt rollers 4, and a pair of exit rollers 5. The individual rollers 30, 30', and 40, 40', and 50, 50' of the pairs 3, 4, and 5 are freely rotatable and as illustrated in FIG. 1 rest in their operating position, under the load given to them by the supporting arm 2 on associated lower rollers 6 and, respectively, 7 and 8 which extends the length of the frame. The lower rollers 6, 7, and 8 are driven through conventional drive means, not illustrated. The slubbing 9 to be stretched or drawn is fed between the upper rollers 30, and the lower roller 6 passing through the assorted rollers 40 and 7, and 50 and 8 passing outwardly as a thread 10. Similarly a slubbing 9' is drawn to a thread 10' through the rollers 30', 40', 50'. Each of the threads 10, 10' are wound on a cop each seated on a spindle, also not illustrated in the drawings. Each of the exiting threads is provided with means for monitoring its continuity and for activating a clamping device, in case of breakage. The clamping device is conventional and is associated with the slubbing at the entrance to the draw frame, as a result of which the continued running of the slubbing may be arrested, loss of material eliminated and lapping of the slubbing on the running rollers may be prevented. The monitoring device assigned to the two slubbings and threads are identical, and the one assigned to the slubbing 9 and the thread 10, hereafter, is described and the parts of the arrangement assigned to the slubbing 9' and the thread 10' are denoted by the identical reference numbers supplemented by the symbol '.

A supporting bracket 12 is mounted on the rod 1 and held in fixed position by a screw 11. A bearing rail 14 is inserted in a bore formed in the bracket 12 so as to be movable lengthwise and is tightly clamped by a screw 13. The supporting bracket 12 is thus adjustably securable on the support rod 1 so as to selectively pivotable about and movable along the axis of the rod. The bearing rail 14 extends laterally to the upper rollers 30, 40, 50, and parallel to the supporting arm 2, permitting unobstructed swivel movement of the supporting arm 2 for the lifting off of the upper rollers from and, respectively, the placing of same on the lower rollers.

A carrier generally denoted by 15, on which the parts forming the sensor are aroused, is fastened to the end of the bearing rail 14. The sensor comprises a light source 16 which is supplied by direct current, and a light-sensitive cell 17. The source 16 and the cell 17 are arranged adjacent to one another on the carrier 15. The carrier 15 is provided with openings in the shape for receiving and positioning the light source 16, and cell 17, so that they can then be selectively inserted into the carrier in such a way that they are positioned to operate on one or other of its sides. In this way it is possible, as is shown in FIG. 1, to arrange the carriers 15, 15' in pairs, with their light sources and light-sensitive cells facing each other.

The cell 17 can be a single cell, or it can also consist of individual partial cells connected in parallel to one another, for instance, as shown, of three partial cells.

The openings provided in the carrier 15 can contain resilient contact studs plugs, etc. coupling the parts 16 and 17, which are provided with respective external contacts, with a power and connection cable 18 laid inside of (as illustrated) or on the bearing rail 14. The contact studs hold the parts at the same time firmly mechanically in the openings. The parts 16 and 17 can also be fastened in other ways and be directly connected with the cable 18. The cable 18 ends in a plug 19 which is to be connected to a power line. The cable 18 also includes a line connecting the cell 17 with switch means located in a housing 20 on the bearing rail 14 for activating the slubbing clamping device.

As shown in FIG. 1, the light sources 16 and 16' mounted on the carriers 15 and 15', respectively, and the light-sensitive cells 17 and 17' which face each other in pairs, result in path of rays 116 which emanate from the light source 16 striking the path of movement of the thread 10' passing near the light-sensitive cell 17 and a path of rays 116' which strike the path of movement of the thread 10. The cell 17 therefore receives the shadow of the thread 10, generating an althernative current corresponding to the vibration of the running thread, whereas the cell 17' generates an alternating current corresponding to the shadow of the vibrating thread 10' received by it. These alternating current signals indicate the continuous and perfect running of the threads 10, 10'.

Because the thread 10 is at a relatively great distance from the cell 17' and similarly the thread 10' is at a relatively great distance from the cell 17, the fact that they seem close to the respective light source for each cell, does not create or result in any undue interference or shadow on the respective cells. At most, a slight decrease in brightness may occur, which has no influence on the generation of the alternating current by the assigned thread. Conversely, incident daylight also will cause an increase in brightness which remains without any effect on the generation of a useable alternating current. Incident light coming from alternating current sources of artificial light can be damped and made ineffective within the electrical circuit, connected downstream, by suitable known electrical circuit members attuned to this frequency. In any event, the frequency, which has to be made ineffective, lies outside the utilized frequency range provided by the thread vibration.

The type of detachable fastening of the bearing rail 14 in the support bracket 12 as described in the foregoing permits the selective alignment of the light sources 16 and 16' with the threads 10' and 10 assigned to them and with the cells 17' and 17, respectively, even though the carrier 15 is firmly connected with the bearing rail 14. To simplify this alignment, the carrier 15 can also be fastened in an adjustable manner to the bearing rail 14. The possibilities for selective adjustment is enhanced if, as shown in the drawing, the carrier 15 is divided into a partial carrier **15*a* for the light source 16 and a partial carrier 15*b* for the light sensitive cell 17. The partial carrier 15*b* is mounted with a sleevelike neck 115*a* on the cylinder-shaped end piece of the bearing rail 14 and is thus held, adjustable in length and rotatable on the latter, and may be fixed in position on it by a clamping screw 21. Placed over the neck 115*a* so as to be movable lengthwise and rotatable about it is a sleeve 23 capable of being fixed in position by a clamping screw 22. The partial carrier 15*b* is fastened to the flattened lateral surface of the sleeve 23 by means of a screw 24 so that it is swivable about the axis of the screw. This adjustability of the partial carrier 15*b* is relative to the partial carrier 15*a* and its adjustability on the bearing rail 14 provides infinite possibilities for aligning the paths of rays 116 and 116'** with the assigned threads and cells and for the alignment of the cells with the area in which the movement of the threads occur.

In FIG. 2, the dot-dash lines 110' mark the angular spread within which the thread runs from the pair of final delivery rollers, to a thread guide movable up and down on the machine before winding on the cop. As seen with regard to thread 10' the partial carrier **15*b*' for the light-sensitive cell 17' and the partial carrier 15*a* for the light source 16 are adjusted in such a way that the cell 17' receives during all runs of the thread 10' within the angular spread 110' a shadow of the thread 10' generated by the path of rays 116. In the same way, the partial carriers 15*b* and 15*a*' are aligned with each other and the thread 10 so that the shadow of the thread 10 generated by the path of rays 116' falls on the cell 17**. By using more than one light-sensitive cell, it is possible to so dimension the light-receiving angle of the individual cell, as for example by the use of an optical member such as a lens or prism so that it is smaller than the normal receiving angle, thus reducing or even preventing outside light incidence on the cell.

The clamping device actuated by the switch means located in housing 20 may be of any form of construction. One such clamping device is illustrated and described in DE-OS No. 20 48 579. As applied here it may comprise a blocking shell or partial sleeve 25 placed on the lower entry roller 6, encompassing the circumference of the lower roller by slightly more than one half, and having about the same length axially as the upper roller 30. By means of a coupling-lug provided on its marginal surface, the sleeve 25 is connected to a projection 26 formed on a slide rod 27 which is movable lengthwise along the bearing rail 14. The slide 27 extends all the way into the housing 20 and is connected to a solenoid arranged in the latter which forms the switch. The solenoid engages the slide 27 with its movable piston or with a pawl or the like actuated by the piston holding the slide in the position as illustrated, in which the sleeve 25 is outside the contact area between the entry rolls 30 and 6.

In the event that the thread 10 should break, the alternating current generated by the cell 17 is absent and the electrical circuit accommodated in the housing 20, connected with the cell 17 by means of the cable 18, transmits a switching pulse for the solenoid, the anchor of which releases the barrier holding the slide 27. As a result, the sleeve 25 is caused to rotate about the lower roller 6 so that it penetrates with its wedge-shaped longitudinal edge between the incoming slubbing 9 and the lower roller 6 and afterwards into a full clamping position between the pair of entry rollers 30, 6. The continued rotation of the sleeve 25 is prevented by limiting the movement of the slide 27. Thus the slubbing 9, which is removed from the still rotating lower roller 6, rests on the outer surface of the sleeve 25. The upper roller 30 rests on the sleeve 25 and is now at a standstill, holding the slubbing 9 against any movement by clamping it to the sleeve 25. Loss of slubbing and lapping of the slubbing around the draw frame rollers after yarn breakage is thereby prevented. A resetting of the clamping members into the normally operating position for the draw frame is possible by manual actuation of a handle formed on the sleeve 25 or slide 27. The manipulations required for repiecing the thread or yarn at the draw frame exit can be performed without interference from the thread monitor components because the latter are located laterally, to the side of the area of manipulation.

During manipulation of the thread or other maintenance procedures at the running spinning site, short-term interruption of the ray paths 116, 116' may occur. This is especially so when piecing is performed at a spinning site adjacent to one still in operation. When the path of rays is interrupted, just as with yarn breakage, the alternating current generated by the affected cell is absent. This absence occurs also if the thread runs vibration-free for a brief period. To prevent, in such cases, the clamping device from being unnecessarily actuated by the switching part, a time delay member is inserted into the electric circuitry effective between the light-sensitive cell and the switching part, so that delivery of a switching pulse is delayed for a determinable time after omission of the alternating current, e.g., within a time range of a few seconds, (e.g. 5 seconds). In circumstances of actual yarn breakage this delay produces no disadvantage since the loss of material in this short period is negligible and the continued running of the slubbing for so short a time cannot lead to lapping.

The thread monitor with the clamping device is a self-contained structural group which can be assembled separately from the machine itself and may also be mounted subsequently in a simple manner on a machine which is already in operation. The simple assembly, the adjustability to the machine, and the manifold possibilities of adjustment of the thread monitor components make it possible to use the device with draw frames of variable design and total length of the draft zone operating with double upper rollers.

Various modifications, changes and alternative embodiments have been disclosed here, others will be obvious to those skilled in this art. Accordingly, the present disclosure is intended to be illustrative only and not limiting of its scope, which is defined only by the appended claims.

What is claimed is:

1. In a thread or yarn spinning machine having a drawing frame having at least a set of inlet rollers for receiving material from a source, and a set of exit rollers spaced from the inlet rollers and between which said material is drawn and from which said drawn material is fed to a spindle or the like, each of said inlet and exit roller sets comprising a lower driven roller and a pair of axial spaced upper rollers permitting the drawing of two materials side by side, said upper rollers being journalled in ranked pairs on a common supporting arm extending in the direction of drawing, apparatus for sensing the continuity of the exiting thread and controlling the supply of material to the frame comprising a bearing rail extending along each side of the frame and spaced laterally from the outer edge of the respective double rollers, each rail having in opposition to each other, at its end adjacent the area where the thread leaves the exit rollers, a light source and a light receiving cell, the respective light sources being arranged in association with the opposite receiving cells so that the shadow of the thread remote from the light source and adjacent the associated receiving cell is cast on said associated receiving cell, means for selectively arresting the delivery of said material to each of said inlet roller sets and means responsive to the sensing of the breakage of the thread by said receiving cell for actuating said means for arresting said slubbing.

2. The apparatus according to claim 1 wherein said light source and said receiving cells are mounted on a carrier adjustably secured to said bearing rail.

3. The apparatus according to claim 2 wherein each carrier is formed of a pair of brackets, one bracket mounting the light source, the other bracket mounting the receiving cell, said brackets being adjustable along the axis and about the axis of said bearing rail relative to said bearing rail and to each other.

4. The apparatus according to claim 3 wherein the bracket mounting said receiving cell is pivotally dependant from said bracket mounting said light source and is adjustable about said pivot axis relative thereto.

5. The apparatus according to claim 1 wherein the bearing rails extend parallel to the supporting arm and are pivotally mounted to the machine frame at the end adjacent the inlet rollers.

6. The apparatus according to claim 1 wherein said bearing rails are mounted to be adjustable in the direction of their extension.

7. The apparatus according to claim 1 wherein the light-sensitive cell comprises a plurality of cells arranged adjacent to each other and connected in parallel to each other.

* * * * *